US007689155B2

(12) United States Patent
Fukuta

(10) Patent No.: US 7,689,155 B2
(45) Date of Patent: Mar. 30, 2010

(54) CLEANING MEMBER FOR PHOTOSENSITIVE DRUM

(75) Inventor: Kazushi Fukuta, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 617 days.

(21) Appl. No.: 11/493,817

(22) Filed: Jul. 27, 2006

(65) Prior Publication Data

US 2007/0025785 A1 Feb. 1, 2007

(30) Foreign Application Priority Data

Jul. 27, 2005 (JP) ..... 2005-216700

(51) Int. Cl.
*G03G 21/00* (2006.01)

(52) U.S. Cl. ..... 399/353

(58) Field of Classification Search ..... 399/149, 399/150, 353, 354, 355; 492/29; 430/119.85; 15/32–34, 106, 256.5, 256.51, 256.52, 256.53
See application file for complete search history.

(56) References Cited

U.S. PATENT DOCUMENTS

| | | | | | |
|---|---|---|---|---|---|
| 3,917,883 | A | * | 11/1975 | Jepson | 427/198 |
| 3,998,681 | A | * | 12/1976 | Williams et al. | 156/154 |
| 4,032,196 | A | * | 6/1977 | Kandel | 300/21 |
| 4,407,219 | A | * | 10/1983 | Dellevoet | 118/60 |
| 5,121,167 | A | * | 6/1992 | Gundlach | 399/343 |
| 5,198,293 | A | * | 3/1993 | Metrick | 442/151 |
| 5,216,467 | A | * | 6/1993 | Esser et al. | 399/103 |
| 5,479,249 | A | * | 12/1995 | Jugle et al. | 399/349 |
| 5,609,431 | A | * | 3/1997 | Carroll | 401/201 |
| 5,652,649 | A | * | 7/1997 | Ikegawa et al. | 399/175 |
| 6,350,504 | B1 | * | 2/2002 | Alboom et al. | 428/88 |
| 6,480,695 | B2 | | 11/2002 | Endo | |
| 6,728,508 | B2 | * | 4/2004 | Kabashima et al. | 399/349 |
| 6,853,834 | B2 | * | 2/2005 | Kurimoto et al. | 399/353 |
| 6,909,449 | B2 | * | 6/2005 | Beyer | 347/262 |
| 2001/0022910 | A1 | * | 9/2001 | Sawayama | 399/353 |
| 2005/0019056 | A1 | | 1/2005 | Nishimura | |
| 2005/0031828 | A1 | * | 2/2005 | Yoshida | 428/92 |

FOREIGN PATENT DOCUMENTS

| | | | | |
|---|---|---|---|---|
| EP | 0 784-248 | A1 | | 7/1997 |
| JP | 57000676 | A | * | 1/1982 |
| JP | 60159774 | A | * | 8/1985 |
| JP | 63-107463 | | | 7/1988 |
| JP | 1-198783 | | | 8/1989 |
| JP | 3-077989 | | | 4/1991 |
| JP | 7-064456 | | | 3/1995 |
| JP | 9-197935 | | | 7/1997 |
| JP | 2001281991 | A | * | 10/2001 |
| JP | 2002-031996 | | | 1/2002 |
| JP | 2005-043801 | | | 2/2005 |

* cited by examiner

*Primary Examiner*—Robert Beatty
(74) *Attorney, Agent, or Firm*—Banner & Witcoff, Ltd.

(57) ABSTRACT

A cleaning member is for use in contact with a photosensitive member in an electrophotographic process to remove a paper dust adhered to the photosensitive member. The cleaning member includes: a base fabric; and fibers electrostatically implanted on a surface of the base fabric and lying substantially flat along the surface of the base fabric.

19 Claims, 5 Drawing Sheets

CLEANING MEMBER FOR PHOTOSENSITIVE DRUM

CROSS REFERENCE TO RELATED APPLICATIONS

This application claims priority from Japanese Patent Application No. 2005-216700 filed Jul. 27, 2005. The entire content of this priority application is incorporated herein by reference.

TECHNICAL FIELD

The disclosure relates to a cleaning member that contacts against a photosensitive member used in an electrophotographic process. In particular, the invention relates to a cleaning member for removing a paper dust adhered to the photosensitive member. Furthermore, the invention relates to a photosensitive member cartridge and an image forming apparatus that have the cleaning member.

BACKGROUND

For example, a laser printer employs the electrophotographic process. In the electrophotographic process, a process of charging a rotating photosensitive member, a process of exposing the photosensitive member, a process of adhering a developer to an exposed region or an unexposed region of the photosensitive member and a process of transferring the developer adhered to the photosensitive member on a printing sheet are performed.

The photosensitive member contacts against the printing sheet to transfer the developer adhered thereto on the printing sheet. At this time, a paper dust of the printing sheet may adhere to the photosensitive member. The paper dust is so large as to exceed 1 mm in size in some cases. When the paper dust remains on the photosensitive member, insufficient charging and proper exposure of the photosensitive member can occur at the point where the paper dust is adhered. In this case, an unintended printing result is obtained. Accordingly, the paper dust adhered to the photosensitive member need to be removed.

United States Patent Application Publication No. 2005/0019056A1 has proposed a brush member, in which a plurality of fibers are sparsely arranged in a standing state, is brought into contact with the photosensitive member, thereby knocking the paper dust off the photosensitive member.

U.S. Pat. No. 6,480,695B2 discloses electrically removing the paper dust adhered to the photosensitive member. By utilizing the potential difference between a cleaning roller to which voltage is applied and the photosensitive member, the cleaning roller catches the paper dust from the photosensitive member. A member for removing the caught paper dust from the cleaning roller is in contact with the cleaning roller. The U.S. Pat. No. 6,480,695B2 also discloses the use of a rubber blade that contacts against the photosensitive member. This blade extends in the axial direction of the photosensitive member. The blade is in contact with the photosensitive member in the axial direction of the photosensitive member without any gap. Such blade can remove the paper dust adhered to the photosensitive member.

SUMMARY

When the above-described brush member is used, there may be a case where the paper dust cannot be knocked off the brush member and is caught between the fibers of the brush member. Since the paper dust is large and contains a hard ingredient, the paper dust caught in the brush member may damage the photosensitive member.

When the paper dust adhered to the photosensitive member is electrically removed using the cleaning roller, the paper dust does not damage the photosensitive member. However, the cleaning roller, a mechanism for applying voltage to the cleaning roller and a member for removing the paper dust from the cleaning roller need to be provided. As a result, manufacturing cost is increased.

When the blade is used, the paper dust is not caught by the blade and the manufacturing cost of the apparatus is not increased. However, when the paper dust is removed by the blade, large friction between the blade and the photosensitive member causes deformation of the blade and damage of the photosensitive member.

In view of the above, an object of the invention is to provide an improved cleaning member for photosensitive member.

In order to attain the above and other objects, the invention provides a cleaning member for use in contact with a photosensitive member in an electrophotographic process to remove a paper dust adhered to the photosensitive member, the cleaning member including: a base fabric; and fibers electrostatically implanted on a surface of the base fabric and lying substantially flat along the surface of the base fabric.

According to another aspect, the invention provides a photosensitive member cartridge that is detachably attachable to an image forming apparatus, the photosensitive member cartridge including: a photosensitive member; and the cleaning member, the fibers being in contact with the photosensitive member.

According to another aspect, the invention provides an image forming apparatus including: a photosensitive member; and the cleaning member, the fibers being in contact with the photosensitive member.

BRIEF DESCRIPTION OF THE DRAWINGS

Illustrative aspects in accordance with the invention will be described in detail with reference to the following figures wherein.

DETAILED DESCRIPTION

Figure 1:
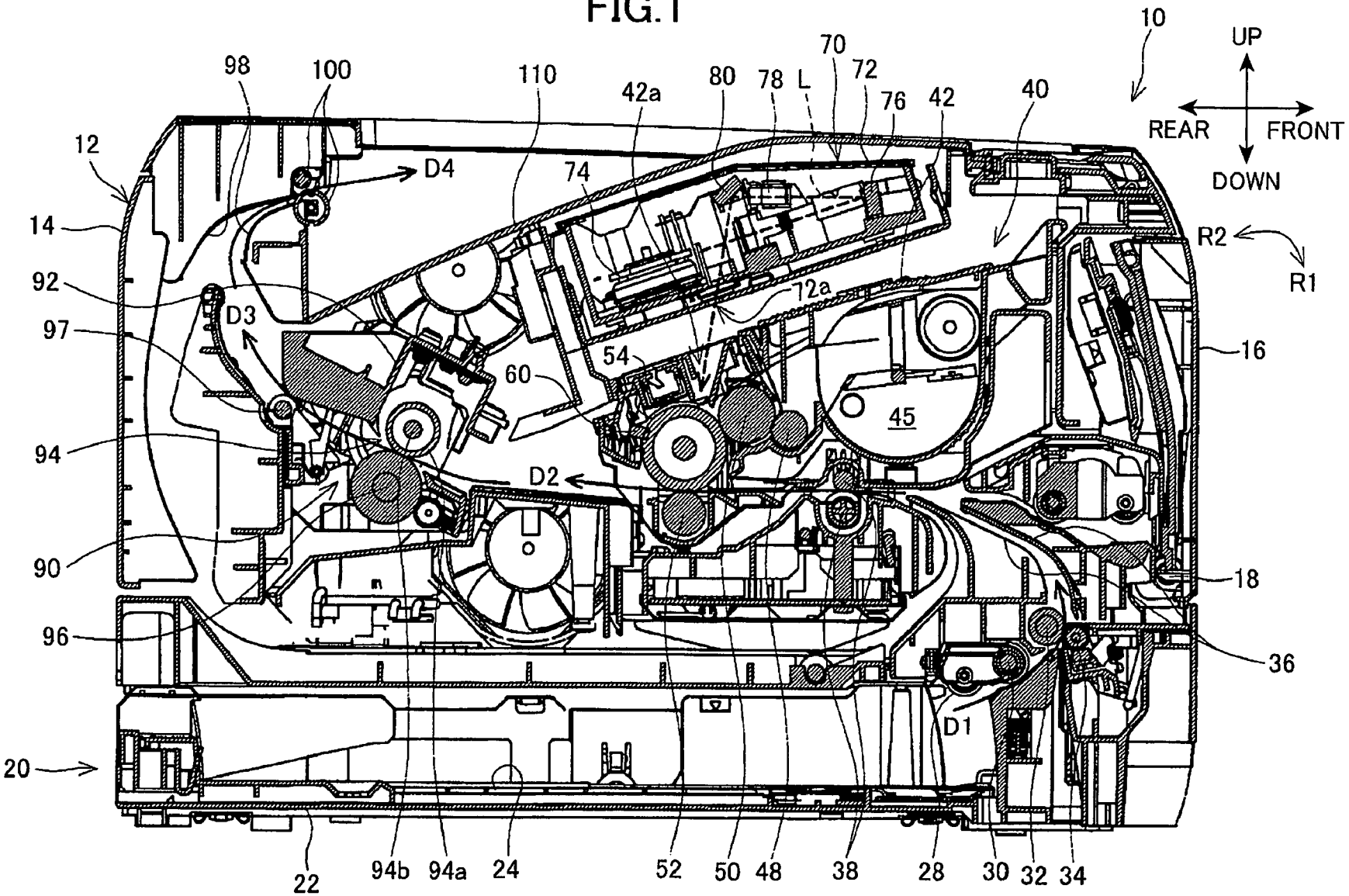
FIG. 1 is a sectional view of a laser printer according to an aspect of the invention.

A cleaning member according to some aspects of the invention will be described while referring to the accompanying drawings wherein like parts and components are designated by the same reference numerals to avoid duplicating description.

FIG. 1 is a sectional view of a laser printer 10 according to one aspect of the invention.

In the following description, the expressions "front", "rear", "upper", "lower", "right", and "left" are used to define the various parts when the printer 10 is disposed in an orientation in which it is intended to be used as shown in FIG. 1.

The printer 10 has a casing 12. The casing 12 is formed of a plurality of plate-like members. FIG. 1 shows a rear cover member 14 and a front cover member 16 forming a part of the casing 12. The front cover member 16 can swing about a shaft 18. By swinging the front cover member 16, the casing 12 can be opened or closed. When the front cover member 16 swings in the direction of an arrow R1, the casing 12 is opened. In this state, a process cartridge 40 described later can be replaced. When the front cover member 16 swings in the direction of an arrow R2, the casing 12 is closed.

The printer 10 has a sheet feeding device 20, a process cartridge 40, an exposing device 70 and a toner fixing device 90. These devices 20, 40, 70 and 90 are disposed in the casing 12.

The sheet feeding device 20 has a sheet feeding tray 22 and four rollers 28, 30, 32 and 34. The sheet feeding tray 22 can move to the front from the state shown in FIG. 1. When the sheet feeding tray 22 moves to the front, the sheet feeding tray 22 can be removed from the casing 12. In this state, the printing sheets (not shown) can be filled into the paper feeding tray 22 through an upper opening of the sheet feeding tray 22. When the sheet feeding tray 22 into which the printing sheets are filled moves to the rear, the sheet feeding tray 22 can be stored in the casing 12.

The sheet feeding tray 22 has a base plate 24 on which stacked printing sheets are mounted. A top printing sheet mounted on the base plate 24 contacts against a sheet feeding roller 28. In the state where the sheet feeding tray 22 is stored in the casing 12, a front end of the base plate 24 is urged upward by a mechanism not shown. Thus, when the number of printing sheets is decreased, only the front end of the base plate 24 rises. With this configuration, the top printing sheet can be kept in contact with the sheet feeding roller 28.

The sheet feeding roller 28 is connected to a drive source not shown. The sheet feeding roller 28 can rotate counterclockwise. When the sheet feeding roller 28 rotates, the top printing sheet stored in the sheet feeding tray 22 is sent to the front (an arrow D1). The printing sheet sent to the front contacts against a separating roller 30. The separating roller 30 is not connected to a drive source. The separating roller 30 contacts against the printing sheet, thereby rotating counterclockwise. When a plurality of printing sheets are fed together, the separating roller 30 separates only one printing sheet from the remaining sheets so that it may be fed downstream. The printing sheet having passed by the separating roller 30 is fed between a pinch roller 32 and a paper dust removing roller 34.

The pinch roller 32 and the paper dust removing roller 34 are not connected to a drive source. The pinch roller 32 is urged toward the side of the paper dust removing roller 34 by an urging mechanism not shown. The printing sheet held between the pinch roller 32 and the paper dust removing roller 34 is pressed on the paper dust removing roller 34 by the pinch roller 32. The surface of the paper dust removing roller 34 is subject to special processing so as to remove paper dusts of the contacting printing sheet. The printing sheet, from which the paper dust is removed, is fed between two registration rollers 38, 38 along a rail 36.

The lower registration roller 38 is connected to a drive source not shown. By rotating the lower registration roller 38 counterclockwise, the printing sheet can be fed in the direction of the arrow D2. The upper registration roller 38 contacts against the printing sheet sent by the lower registration roller 38, thereby rotating clockwise.

After the printing sheet is fed by the registration roller 38 in the direction of the arrow D2, printing on the printing sheet is performed. Specifically, printing is performed by the process cartridge 40, the exposing device 70 and the fixing device 90.

The process cartridge 40 is detachably mounted in the casing 12. When the front cover 16 is opened (an arrow R1), the process cartridge 40 can be removed from the casing 12. The old process cartridge 40 can be replaced with a new one.

The process cartridge 40 has a casing 42. A through-hole 42*a* is formed through an upper face of the casing 42. A toner chamber 45 is formed in the front portion in the casing 42. The toner is stored in the toner chamber 45. Three rollers 48, 50 and 52 and a photosensitive drum 54 are disposed in the rear portion in the casing 42. These rollers 48, 50 and 52 and the drum 54 each are connected to a drive source not shown. The roller 48 located at the most front position is referred to as a feeding roller. A developing roller 50 is disposed on the rear side of the feeding roller 48. The photosensitive drum 54 is disposed on the rear side of the developing roller 50. A transfer roller 52 is disposed below the photosensitive drum 54. The printing sheet fed by the registration rollers 38 in the direction of the arrow D2 enters between the photosensitive drum 54 and the transfer roller 52. The photosensitive drum 54 rotates clockwise and the transfer roller 52 rotates counterclockwise. The photosensitive drum 54 and the transfer roller 52 rotate, thereby further feeding the printing sheet to the rear (the arrow D2). While the printing sheet is fed to the rear, the toner adhered to the photosensitive drum 54 is transferred to the printing sheet.

A cleaning member 60 contacts against the photosensitive drum 54. The cleaning member 60 removes a paper dust adhered to the photosensitive drum 54. The cleaning member 60 allows the toner adhered to the photosensitive drum 54 to pass by the cleaning member 60. The configuration of the cleaning member 60 will be described in detail later.

The exposing device 70 is disposed above the process cartridge 40. The exposing device 70 is fixed to the casing 12. The exposing device 70 has a casing 72. A through-hole 72*a* is formed through a lower face of the casing 7. The casing 72 includes a polygon mirror 74, a reflecting mirror 76, a lens 78 and a reflecting mirror 80 therein. The exposing device 70 has a light source not shown. The light source emits a laser beam on the basis of contents of printing data. The laser beam emitted from the light source is deflected by the polygon mirror 74 toward the reflecting mirror 76. The laser beam reflects off the reflecting mirror 76 and passes through the lens 78. The laser beam having passed through the lens 78 further reflects off the reflecting mirror 80. The laser beam having reflected off the reflecting mirror 80 goes out of the casing 72 through the through-hole 72*a* and travels downward. The laser beam emitted out of the casing 72 reaches the photosensitive drum 54 through the through-hole 42*a* on the casing 42 of the process cartridge 40. Thus, the photosensitive drum 54 is exposed with a predetermined pattern. A broken line L in FIG. 1 indicates the above-mentioned path of the laser beam.

The toner fixing device 90 is disposed in the rear of the process cartridge 40. The toner fixing device 90 has a frame 92, a heating roller 94 and a pressing roller 96. The frame 92 rotatably supports the heating roller 94 and the pressing roller 96.

The heating roller 94 has a metal tube 94*a* and a halogen lamp 94*b* disposed in the metal tube 94*a*. The halogen lamp 94*b* heats the metal tube 94*a*. The heating roller 94 is connected to a drive source not shown. When the drive source operates, the heating roller 96 rotates clockwise. The pressing roller 96 is urged toward the side of the heating roller 94 by a mechanism not shown. The surface of the pressing roller 96 is made of rubber. The pressing roller 96 is not connected to the drive source. When the heating roller 94 rotates clockwise, the pressing roller 96 rotates counterclockwise following the rotation of the heating roller 94.

The printing sheet having passed through the process cartridge 40 enters between the heating roller 94 and the pressing roller 96. When the heating roller 94 rotates clockwise, the printing sheet held between the heating roller 94 and the pressing roller 96 is fed to the rear. The printing sheet is heated by the heating roller 94 heated to high temperatures. Thus, the toner transferred on the printing sheet is fixed due to heat. The printing sheet having passed through the toner fixing device 90 is fed in the upper rear direction (an arrow D3).

A conveying roller 97 is disposed under the rear end of the frame 92. The conveying roller 97 is rotatably supported by the casing 12. The conveying roller 97 is connected to a drive source not shown. The conveying roller 97 rotates counterclockwise. The conveying roller 97 feeds the printing sheet sent through the toner fixing device 90 further in the upper rear direction. The printing sheet sent to the upper rear is fed to the front along the rail 98.

Two sheet discharging rollers 100, 100 are arranged on the front side of the rail 98. The lower sheet discharging roller 100 is connected to a drive source not shown. The lower sheet discharging roller 100 rotates clockwise. The upper sheet discharging roller 100 is not connected to a drive source. When the lower sheet discharging roller 100 rotates clockwise, the upper sheet discharging roller 100 rotates counterclockwise following the rotation of the lower sheet discharging roller 100.

The printing sheet fed by the conveying roller 96 enters between the two sheet discharging rollers 100, 100. When the lower sheet discharging roller 100 rotates clockwise, the printing sheet held between the two sheet discharging rollers 100, 100 is fed to the front. The printing sheet is sent out of the casing 12. A sheet output tray 110 is formed on the upper face of the casing 12. The printing sheet sent out of the casing 12 is discharged on the sheet output tray 110.

Figure 2:
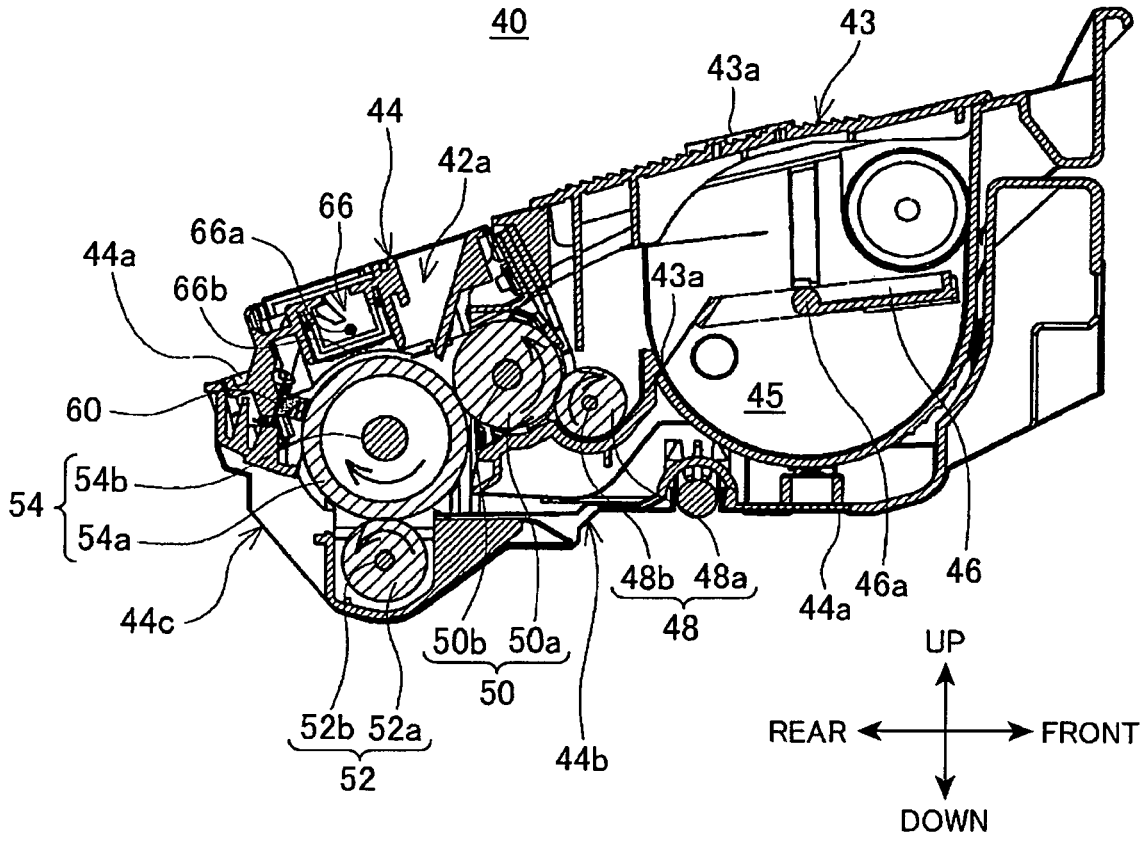
FIG. 2 is an enlarged sectional view of a process cartridge.

Next, with reference to FIG. 2, the detailed configuration of the process cartridge 40 will be described. FIG. 2 is an enlarged sectional view of the process cartridge 40.

Figure 3:
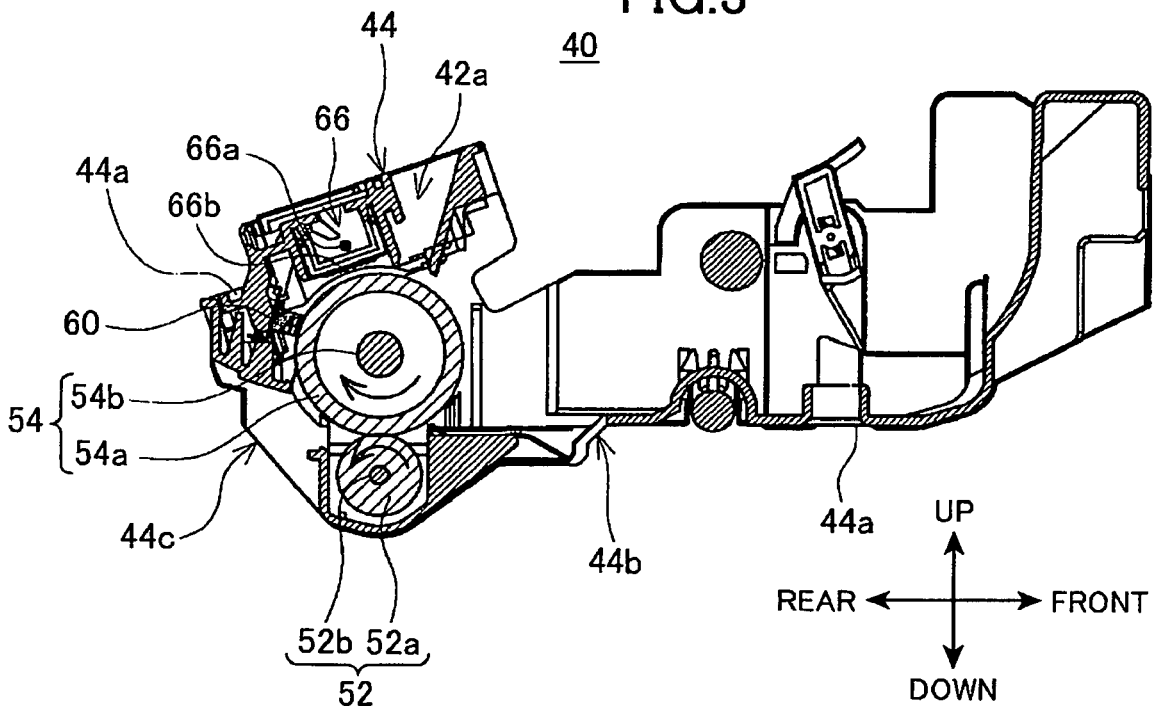
FIG. 3 is a sectional view of a photosensitive drum cartridge.

The process cartridge 40 is formed of two cartridges 43 and 44. The front cartridge 43 is referred to as a developing cartridge and the rear cartridge 44 is referred to as a photosensitive drum cartridge. The developing cartridge 43 and the photosensitive drum cartridge 44 are detachably connected to each other. FIG. 3 is a sectional view of the photosensitive drum cartridge 44, from which the developing cartridge 43 is separated. The use of the process cartridge 40 enables replacement of only the developing cartridge 43 or the photosensitive drum cartridge 44 as well as the whole process cartridge 40.

The configuration of the developing cartridge 43 will be described below.

The developing cartridge 43 has a casing 43*a*. The toner chamber 45 is formed in the casing 43*a*. The feeding roller 48 and the developing roller 50 are arranged on the rear side of the toner chamber 45. The feeding roller 48 and the developing roller 50 are accommodated in the casing 43*a*. The toner is stored in the toner chamber 45.

In this example, the toner is a nonmagnetic, single-component toner having a positive charging nature. The toner used in this example is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation. This type of toner is compounded with a coloring agent or wax, as well as an additive such as silica to improve fluidity. The average diameter of the toner particles is about 6-10 μm.

An agitator 46 is accommodated in the toner chamber 45. The agitator 46 is attached to the casing 43*a* so as to be rotatable about a shaft 46*a*. When the agitator 46 rotates clockwise, the toner in the toner chamber 45 is agitated. Thus, the toner is supplied to the feeding roller 48.

The feeding roller 48 has a feeding roller body 48*a* and a feeding roller shaft 48*b*. The feeding roller body 48*a* is made of a conductive foamed material. The feeding roller shaft 48*b* is made of metal. The feeding roller 48 is rotatably supported by the casing 43*a* of the developing cartridge 43. The feeding roller 48 is connected to a drive source not shown. The feeding roller 48 rotates clockwise.

The developing roller 50 disposed on the rear side of the feeding roller 48 firmly contacts against the feeding roller 48. The developing roller 50 has a developing roller body 50*a* and a developing roller shaft 50*b*. The developing roller body 50*a* is made of a conductive rubber material. Conductive urethane rubber or silicone rubber containing carbon fine particles may be adopted as the rubber material. The surface of the urethane rubber or the silicone rubber is coated with urethane rubber or silicone rubber containing fluorine. The developing roller shaft 50*b* is made of metal. The developing roller shaft 50*b* is connected to a voltage supply circuit not shown. During development to cause the toner to be adhered to the photosensitive drum 54, the voltage supply circuit applies a bias to the developing roller 50. The developing roller 50 is rotatably supported by the casing 43*a* of the developing cartridge 43. The developing roller 50 is connected to a drive source not shown. The developing roller 50 rotates counterclockwise.

Next, the configuration of the photosensitive drum cartridge 44 will be described.

The photosensitive drum cartridge 44 has a casing 44*a*. The through-hole 42*a*, through which the laser beam passes, is formed on an upper face of the casing 44*a*. A let-in through-hole 44*b* for letting the printing sheet in is formed on a lower face of the casing 44*a*. A let-off through-hole 44*c* for letting the printing sheet out is formed on a rear side face of the casing 44*a*. The printing sheet enters the photosensitive drum cartridge 44 from the let-in through-hole 44*b*, passes between the photosensitive drum 54 and the transfer roller 52 and goes out from the let-off through-hole 44*c*.

The photosensitive drum 54, the transfer roller 52, a charger 66 and the cleaning member 60 are arranged in the casing 44*a* of the photosensitive drum cartridge 44.

The photosensitive drum 54 located on the rear side of the developing roller 50 contacts against the developing roller 50. The photosensitive drum 54 has a photosensitive drum body 54*a* and a photosensitive drum shaft 54*b*. The photosensitive drum body 54*a* is cylindrical. The photosensitive drum body 54*a* is a photosensitive member having a positively-charging nature. The surface of the photosensitive drum body 54*a* is formed of polycarbonate or the like. The photosensitive drum shaft 54*b* is made of metal. The photosensitive drum shaft 54*b* is fixed to a casing 44*a* of the photosensitive drum cartridge 44. The photosensitive drum body 54*a* is rotatably attached to the photosensitive drum shaft 54*b*. The photosensitive drum body 54*a* is connected to a drive source not shown. The photosensitive drum body 54*a* rotates clockwise.

The transfer roller 52 located under the photosensitive drum 54 contacts against the photosensitive drum 54. The transfer roller 52 has a transfer roller body 52*a* and a transfer roller shaft 52*b*. The transfer roller body 52*a* is made of a conductive rubber material. The transfer roller shaft 52*b* is made of metal. The transfer roller shaft 52*b* is rotatably attached to the casing 44*a* of the photosensitive drum cartridge 44. The transfer roller shaft 52*b* is connected to a drive source not shown. The transfer roller 52 rotates counterclockwise. The transfer roller shaft 52*b* is connected to a voltage supply circuit not shown. During transfer to cause the toner adhered to the photosensitive drum 54 to be transferred onto the printing sheet, the voltage supply circuit applies a bias to the transfer roller 52.

The charger 66 is disposed above the photosensitive drum 54. A gap is provided between the charger 66 and the photosensitive drum 54. The charger 66 is a scorotron type. The charger 66 has a discharge wire 66*a* and a grid 66*b*. The discharge wire 66*a* is a wire extending in the direction parallel to the axial direction of the photosensitive drum 54, that is, in the direction perpendicular to a sheet of FIG. 2. A relatively high voltage is applied to the discharge wire 66*a*. The grid 66*b* is disposed between the discharge wire 66*a* and the photosensitive drum 54. A bias voltage is applied to the grid 66*b* to control the discharge amount of the discharge wire 66*a*. A relatively high voltage is applied to the discharge wire 66*a*, thereby generating corona discharge and a bias voltage is applied to the grid 66*b*. As a result, the surface of the photosensitive drum 54 (photosensitive drum body 54*a*) is positively charged.

The cleaning member 60 is disposed on the rear side of the photosensitive drum 54 so as to come into contact with the photosensitive drum 54. The cleaning member 60 is disposed downstream of the transfer roller 52 and upstream of the charger 66 in the rotating direction of the photosensitive drum 54 (clockwise direction).

Figure 4:
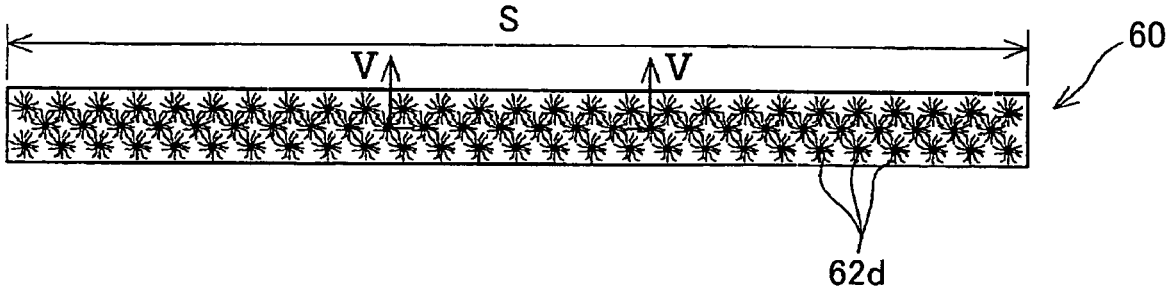
FIG. 4 is a plan view of a cleaning member.

FIG. 4 is a plan view of the cleaning member 60. The cleaning member 60 extends parallel to the rotational axial direction of the photosensitive drum 54, that is, in the direction perpendicular to the sheet of FIG. 2. A horizontal length S of the cleaning member 60 is substantially equal to the length of the photosensitive drum body 54*a* in the axial direction. As shown in FIG. 4, a plurality of fibers 62*d* are electrostatically implanted on the surface of the cleaning member 60.

Figure 5:
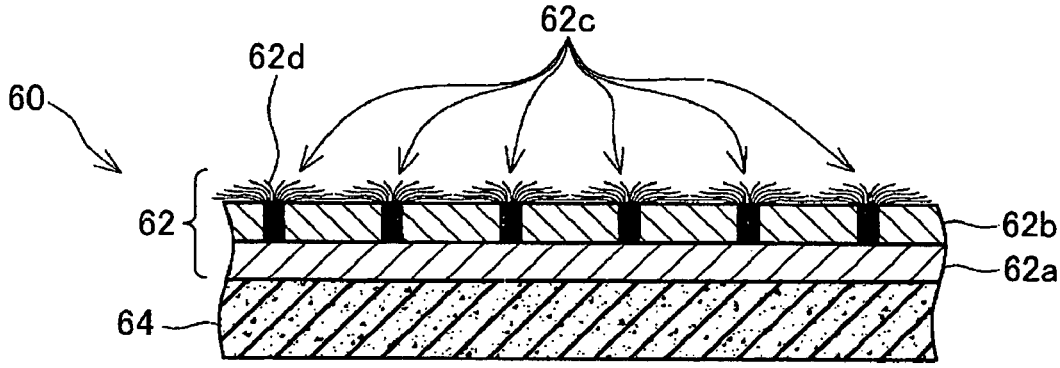
FIG. 5 is a sectional view taken along a line V-V in FIG. 4.

FIG. 5 is a sectional view taken along a line V-V in FIG. 4. As shown in FIG. 5, the cleaning member 60 has a fiber-implanted fabric 62 and a sponge member 64. The fiber-implanted fabric 62 is formed of a base fabric 62*a*, an adhesive layer 62*b* formed on one surface of the base fabric 62*a* and a plurality of fiber bundles 62*c*. The thickness of the base fabric 62*a* is about 0.5 to 0.7 mm. The base fabric 62*a* is made of polyester. The adhesive layer 62*b* is formed by curing an adhesive that is applied when the fiber bundles 62*c* are electrostatically implanted in the base fabric 62*a*. Acrylic resin, urethane resin, polyvinyl acetate resin and synthetic rubber latex can be adopted as the adhesive. Acrylic resin emulsion is especially preferable. A plurality of fiber bundles 62*c* are arranged as being dispersed on the surface of the base fabric 62*a* as shown in FIG. 4. Each of a plurality of fiber bundles 62*c* is formed of a plurality of fibers 62*d*. The fibers 62*d* lie substantially flat along the surface of the base fabric 62*a*. FIG. 4 and FIG. 5 show the state where the fibers 62*d* in each fiber bundle 62*c* lie flat and spread along the surface of the base fabric 62*a* in various directions to extend radially outwardly from the location where the fibers 62*d* are implanted on the base fabric 62*a*.

The diameter of each fiber 62*d* is in a range of 5 to 10 μm. This diameter is almost equal to that of the toner (6 to 10 μm). The length of each fiber 62*d* is in a range of 0.5 to 0.7 mm. The surface density of the fibers 62*d* to the surface of the base fabric 62*a* is 1500 to 15000 pieces/mm$^2$.

The sponge member 64 is bonded, with a double-sided adhesive tape, to the back surface of the fiber-implanted fabric 62 opposite to the surface where the fibers 62*d* are implanted. The thickness of the sponge member 64 is about 6 to 8 mm. The elastic force of the sponge member 64 is adjusted to be about 40 N. The back face of the sponge member 64 is fixed to the casing 44*a* of the photosensitive drum cartridge 44 (refer to FIG. 2, FIG. 3 and FIG. 6) with a double-sided adhesive tape.

Figure 6:
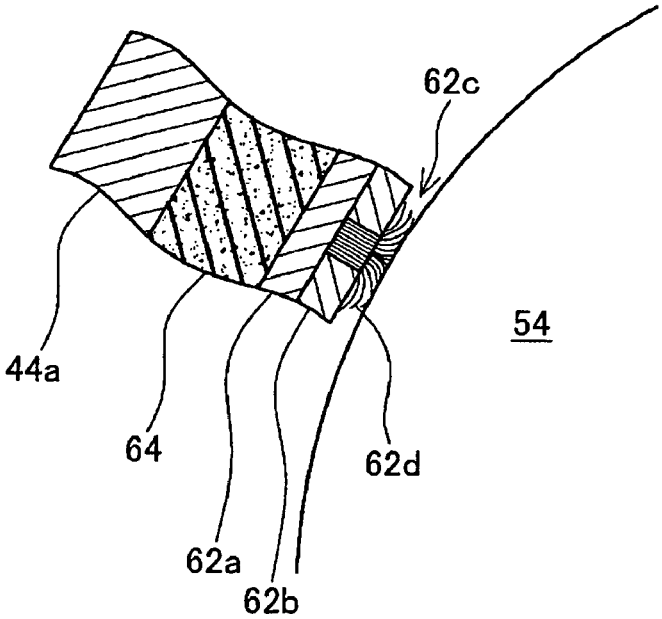
FIG. 6 is an enlarged view showing the state fibers are in contact with a photosensitive drum.

FIG. 6 shows a partial enlarged view of the cleaning member 60. FIG. 6 shows only one fiber bundle 62*c*. As well shown in FIG. 6, each fiber 62*d* is in contact with the photosensitive drum 54. Since each fiber 62*d* lies flat, mainly its middle region (or the side face of the fiber 62*d*) rather than its tip end is in contact with the photosensitive drum 54. In the state where the cleaning member 60 is in contact with the photosensitive drum 54, the sponge member 64 is compressed. For this reason, the elastic force of the sponge member 64 (about 40 N) is applied to the fiber-implanted fabric 62.

With reference to FIG. 7A-7F, a method for manufacturing the cleaning member 60 will be described.

Figure 7A:
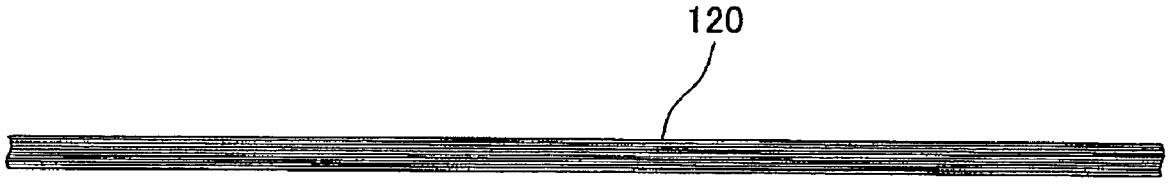
FIG. 7A-FIG. 7F show a method for manufacturing the cleaning member.

(1) First, a plurality of long fibers 120 are tied up in a bundle using a binding agent (FIG. 7A).

Figure 7B:
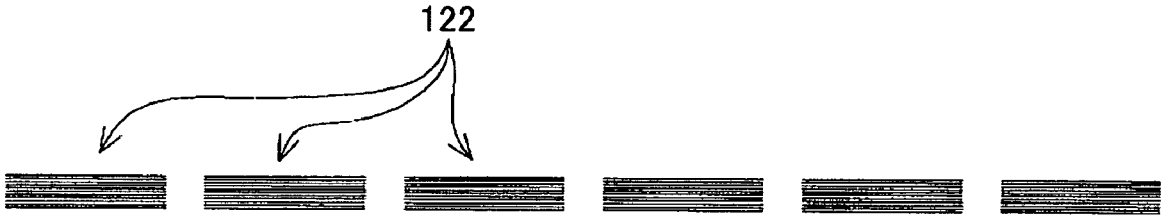

(2) Subsequently, the fiber bundle 120 is cut into lengths of 0.5 to 0.7 mm each (FIG. 7B). The thus cut fiber bundles 122 are each referred to as a short pile.

Figure 7C:
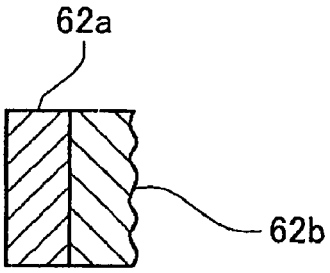

(3) The base fabric 62*a* is prepared. Paste-like adhesive 62*b* is applied on the base fabric 62*a* (FIG. 7C).

Figure 7D:
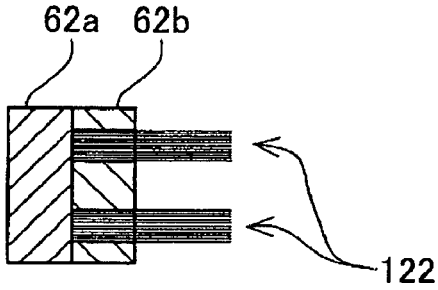

(4) In a high-voltage electrostatic field, the base fabric 62*a* and the short piles 122 are arranged. The piles 122 are attracted to the base fabric 62*a* due to electrostatic force. The short piles 122 stick into the base fabric 62*a* through the adhesive layer 62*b* in a direction perpendicular to the surface of the base fabric 62*a* (FIG. 7D).

Figure 7E:
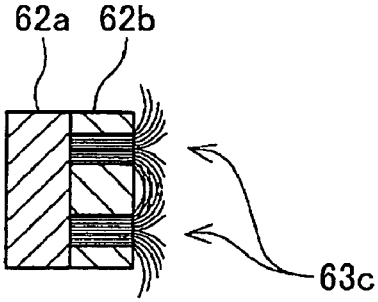

(5) After the adhesive 62*b* is cured, the binding agent is removed, thereby unbinding the short piles 122. In this process, alkaline treatment and solvent treatment can be employed (FIG. 7E). As a result, each fiber 62*d* lies flat.

Figure 7F:
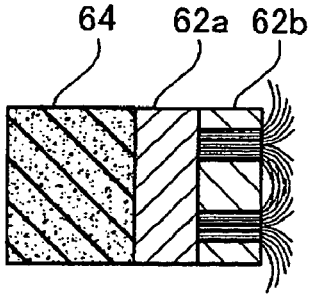

(6) The sponge member 64 is fixed to the back face of the base fabric 62*a* (FIG. 7F). In this manner, the cleaning member 60 is completed.

Next, with reference to FIG. 2, effects of the process cartridge 40 having the above-mentioned configuration will be described.

The toner in the toner chamber 45 is adhered to the feeding roller 48. The toner adhered to the feeding roller 48 is positively charged due to friction between the feeding roller 48 and the developing roller 50. The positively-charged toner covers the surface of the developing roller 50.

The surface of the photosensitive drum body 54*a* is positively charged by the charger 66. The surface of the positively-charged photosensitive drum body 54*a* selectively receives the laser beam emitted from the exposing device 70 (refer to FIG. 1). Some region of the surface of the photosensitive drum body 54*a* is exposed. The potential of the exposed region on the photosensitive drum body 54*a* lowers. Which region is exposed depends on contents to be printed. An electrostatic latent image based on the contents to be printed is formed on the photosensitive drum body 54*a*.

The toner that coats the developing roller 50 is adhered to the exposed region of the photosensitive drum body 54*a*. At this time, the toner is not adhered to unexposed region of the photosensitive drum 54*a*. Thus, the electrostatic latent image formed on the photosensitive drum body 54*a* is made visible.

The toner carried on the photosensitive drum body 54*a* is transferred on the printing sheet held between the photosensitive drum 54 and the transfer roller 52. At this time, a bias is applied to the transfer roller 52. The toner is transferred on the printing sheet due to the potential difference between the photosensitive drum 54 and the transfer roller 52.

The photosensitive drum 54 contacts against the printing sheet. At this time, paper dust of the printing sheet may be adhered to the photosensitive drum 54. The paper dust may be so large as to be visible and in some cases, exceeds 1 mm in size. The paper dust adhered to the photosensitive drum 54 is conveyed in the rotating direction of the photosensitive drum 54 (clockwise direction). The paper dust adhered to the photosensitive drum 54 contacts against the fibers 62*d* of the cleaning member 60 (refer to FIG. 4 and FIG. 5). As a result, the paper dust is knocked off by the fibers 62*d*. Thus, the paper dust adhered to the photosensitive drum 54 is removed. The removed paper dust drops on the inner face of the casing 44*a* of the photosensitive drum cartridge 44 or the printing sheet.

The toner in this example has a very high transfer performance. However, a small amount of toner that is not transferred on the printing sheet still remains on the photosensitive drum 54. The toner remaining on the photosensitive drum 54 is not caught by the fibers 62*d* of the cleaning member 60. The toner remaining on the photosensitive drum 54 passes by the cleaning member 60. The cleaning member 60 is not stained with the toner. The toner remaining on the photosensitive drum 54 is adhered to the developing roller 50. That is, although the toner is conveyed from the developing roller 50 to the photosensitive drum 54 in the normal developing process, the toner is reversely conveyed in this case. This phenomenon occurs as the photosensitive drum 54 is charged again by the charger 66 to generate the potential difference between the photosensitive drum 54 and the developing roller 50. The toner that is reversely moved to the developing roller 50 is charged again between the feeding roller 48 and the developing roller 50 to be reused.

It is noted that if toner had poor transfer performance, a large amount of toner will remain on the photosensitive drum 54. Even when a large amount of toner remains on the photosensitive drum 54, the above-mentioned reverse movement will occur. However, if a large amount of toner remained on the photosensitive drum 54, charging and exposure of the photosensitive drum 54 cannot be performed with high accuracy. That is, the region in which the remaining toner is adhered is not satisfactorily charged or exposed. For this reason, the quality of printing will deteriorate. Furthermore, if a large amount of toner remained on the photosensitive drum 54, all of the remaining toner will not be reversely moved to the developing roller 50. In this case, the remaining toner may be transferred on the printing sheet. Also in this case, the quality of printing will deteriorate. Thus, if the toner had poor transfer performance, the toner remaining on the photosensitive member will need to be removed and a device, such as a blade, for collecting the remaining toner will have to be employed.

Contrarily, according to the present example, since toner having a high transfer performance is used, only a small amount of toner remains on the photosensitive drum 54. Accordingly, the printer 10 can successfully operate as a cleaner-less printer and requires no device for collecting the remaining toner. Since the printer 10 has no device for collecting the remaining toner, the printer 10 can be reduced in size.

It is ensured that the cleaning member 60 removes the paper dust adhered to the photosensitive drum 54. The cleaning member 60 has the fiber-implanted fabric 62 having the electrostatically-implanted fibers 62*d*. The fibers 62*d* spread in various directions along the surface of the fabric 62 to lie flat. Since each lying fiber 62*d* is in contact with the photosensitive drum 54 at its middle portion, the contact area of the photosensitive drum 54 with the fibers 62*d* is large. Accordingly, the paper dust adhered to the photosensitive drum 54 can be prevented from passing by the fibers 62*d*.

Because the fibers 62*d* lie flat and extend in various directions, the paper dust can be effectively removed.

Because the fiber bundles 62*c* each formed by tying the plurality of fibers 62*d* together are arranged as being dispersed on the surface of the base fabric 62*a*, the arrangement density of the fibers 62*d* in each region of the base fabric 62*a* can be made uniform.

The soft fibers 62*d* contact against the photosensitive drum 54 to remove the paper dust. Accordingly, no large friction between the cleaning member 60 and the photosensitive drum 54 occurs and thus, damage of the cleaning member 60 or the photosensitive drum 54 can be prevented.

Furthermore, by using the fiber-implanted fabric 62, the paper dust adhered to the photosensitive drum 54 is not caught between the fibers 62*d*. Thus, the paper dust can be prevented from damaging the photosensitive drum 54.

In this example, the fibers 62*d* each having the diameter (5 to 10 μm) almost equal to that of the toner. It is noted that if the fibers 62*d* each had the diameter smaller than that of the toner, the possibility of catching the toner will increase. If the fibers 62*d* each had the diameter greater than that of the toner, as the diameter of the fibers 62*d* increases, the paper dust will become easier to enter between the fibers 62*d*, thereby increasing the possibility of damaging the photosensitive drum 54. In this example, the fibers 62*d* have the diameter almost equal to that of the toner. Accordingly, the fibers 62*d* can remove the paper dust, while allowing the toner to pass through between the fibers 62*d*. When the diameter of the fibers 62*d* is set to a range between 1 to 3 times as the average particle size of the toner, the fibers 62*d* can attain excellent cleaning performance and excellent toner passage performances.

The length of each fiber 62*d* is set in a range of 0.5 to 0.7 mm and the density of the fibers 62*d* is set in a range of 1,500 to 15,000 pieces/$mm^2$. These numerical ranges can also contribute to removal of the paper dust and passage of the toner.

The sponge member 64 is fixed to the back face of the base fabric 62*a*. The sponge member 64 is elastically deformed to uniformly urge, with its elastic force, the fiber-implanted fabric 62 against the photosensitive drum 54.

It is noted that if the contact pressure of the cleaning member 60 against the photosensitive drum 54 were too large, the photosensitive drum 54 will be damaged. So, it is preferable that the sponge member 64 should generate an elastic force smaller than or equal to 60N. On the other hand, if the contact pressure of the cleaning member 60 against the photosensitive drum were too small, cleaning cannot be effectively performed. So, it is more preferable that the sponge member 64 should generate an elastic force in a range of 20 N to 60N.

In this example, the sponge member 64 applies an elastic force of about 40 N to the fiber-implanted fabric 62. Thus, the fiber-implanted fabric 62 is in contact with the photosensitive drum 54 with a suitable pressing force.

It is noted that using the cleaning member 60 can remove paper dust less costly than a mechanism of removing paper dust by generating a potential difference. If a fixed brush were used, the brush will possibly catch the paper dust and damage the photosensitive drum 54. The cleaning member 60 can prevent such damage. Furthermore, it is unnecessary to frequently perform cleaning or replacement of the cleaning member 60 because the cleaning member 60 can allow toner to pass through between the fibers 62*d* of the cleaning member 60. The cleaning member 60 is thus useful.

The present inventor performed an experiment to cause various members to contact against the photosensitive drum 54 to estimate the cleaning performance in the case of using each member. As a result, it turned out that the fiber-implanted fabric 62 having the base fabric 62*a* and the fibers 62*d* electrostatically implanted on the base fabric 62*a* were suitable.

Further researches revealed that lying fibers rather than standing fibers could exert good cleaning performance. That is, it turned out that when the fibers 62*d* on the base fabric 62*a* lie on the surface of the base fabric 62*a*, the fiber-implanted fabric 62 attained good cleaning performance. It is noted that when most of the fibers 62*d* implanted on the base fabric 62*a* lie on the surface of the base fabric 62*a*, even though a few fibers 62*d* stand on the base fabric 62*a*, the fiber-implanted fabric 62 still attained good cleaning performance.

According to the experiment by the present inventor, it turned out that when the cleaning member 60 was used, the paper dust adhered to the photosensitive drum 54 was hardly caught between the fibers 62*d*. It is supposed that the effect is due to that the electrostatically-implanted fibers 62*d* lie flat.

The experiment by the present inventor further revealed that even though the fibers 62*d* lie flat to increase the contact area of the fibers 62*d* with the photosensitive drum 54, the electrostatically-implanted fibers 62*d* allowed a large part of the toner adhered to the photosensitive drum 54 to pass through among the fibers 62*d* without being caught thereby. It turned out that by using the fiber-implanted fabric 62 manufactured according to the electrostatic implanting method, it is possible to effectively remove the paper dust, while allowing a large part of the toner to pass through among the fibers 62*d* and not to be caught by the fibers 62*d*.

The experiment by the present inventor further revealed that setting the diameter of each fiber 62*d* in a range of 5 to 10 μm, setting the length of each fiber 62*d* in a range of 0.5 to 0.7 mm, and setting the arrangement density of the fibers 62*d* in a range of 1,500 to 15,000 pieces/mm$^2$ attained good effects. By adopting these numerical ranges, it is possible to improve at least one of the effect of removing the paper dust from the photosensitive drum 54, the effect of not catching the paper dust on the fibers 62*d* by knocking the paper dust off the fibers 62*d*, and the effect of allowing the toner to pass among the fibers 62*d*.

The present inventor investigated the influence that the change in the elastic force of the sponge member 64 exerted on the photosensitive drum 54. Specifically, the sponge members having three types of elastic forces of 20 N, 60 N and 127 N, respectively, were prepared. Using the printer 10 to which each sponge member is attached, 300 printing sheets were printed and then, the surface of the photosensitive drum 54 was observed. It was confirmed that a large number of scratches were generated on the surface of the photosensitive drum 54 when the sponge member 64 having the elastic force of 127 N was used, while the surface of the photosensitive drum 54 was fine when the sponge members having the elastic force of 20 N and 60 N were used.

Because the sponge member 64 having the elastic force of 40 N is used as in this example, the surface of the photosensitive drum 54 is not damaged. Moreover, the fiber-implanted fabric 62 can be brought into contact with the photosensitive drum 54 with the pressing force suitable for cleaning.

While the invention has been described in detail with reference to the above aspects thereof, it would be apparent to those skilled in the art that various changes and modifications may be made therein without departing from the spirit of the invention.

Figure 8:
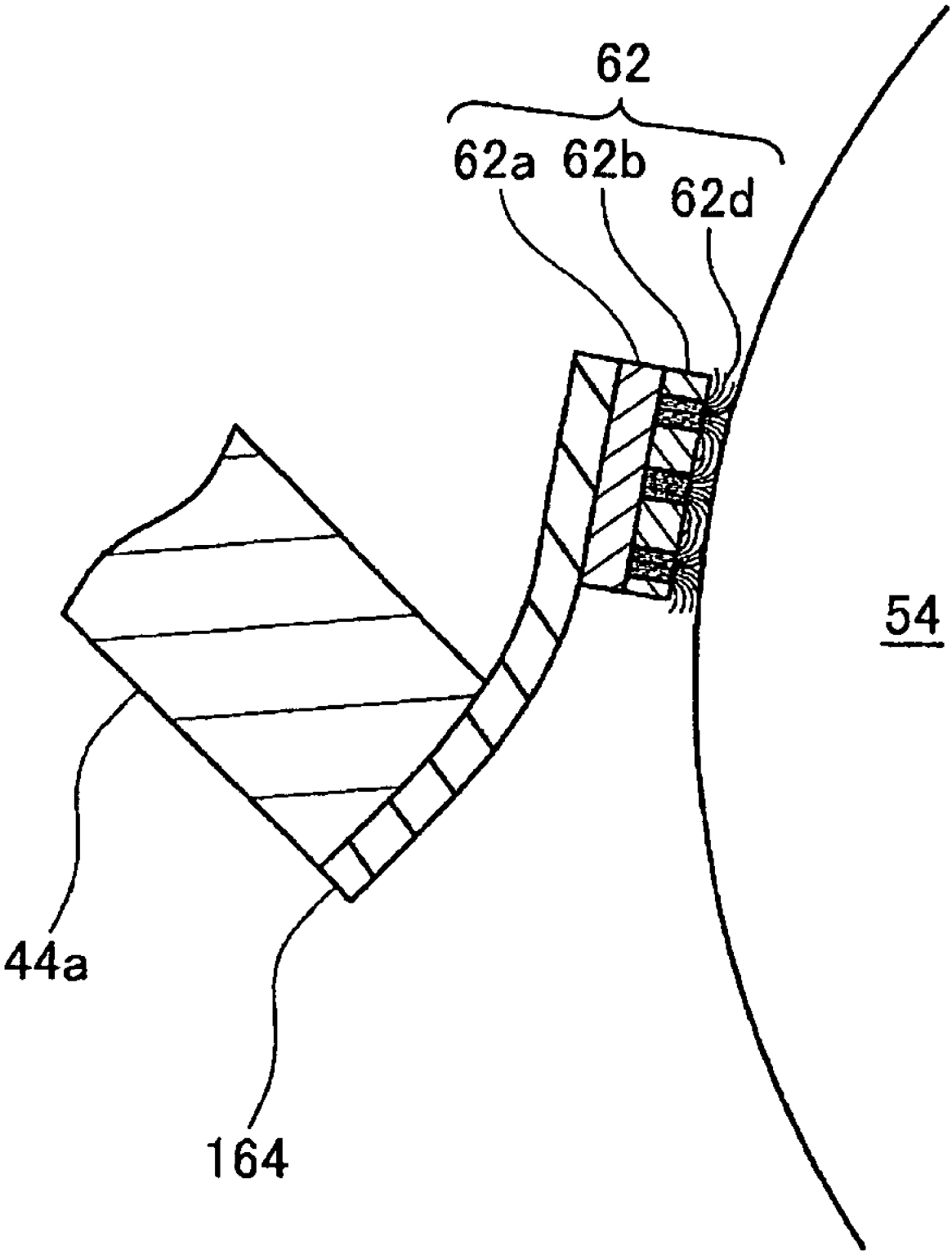
FIG. 8 is a view showing another example of an elastic member.

(1) For example, in the above description, the sponge member 64 generates the elastic force. However, as long as the elastic force can be applied to the fiber-implanted fabric 62, any configuration may be adopted. For example, as shown in FIG. 8, an elastically deformable plate member 164 may be used. A base end of the plate member 164 is attached to the casing 44*a*. The fiber-implanted fabric 62 is attached to a free end of the plate member 164. The positional relationship between the plate member 164 and the photosensitive drum 54 is adjusted so that the plate member 164 can exert an elastic force in a range of 20 to 60 N against the photosensitive drum 54 via the fiber-implanted fabric 62. In this manner, the fiber-implanted fabric 62 can be brought into contact with the photosensitive drum 54 with the pressing force suitable for cleaning.

(2) In the above description, the cleaning member 60 is fixed to the casing 44*a*. However, the cleaning member may be movable. For example, a cylindrical cleaning member, the outer surface of which is coated with the fiber-implanted fabric 62, may be used. The cylindrical cleaning member is configured to rotate about its cylindrical axis.

The printer 10 may not be of a cleaner-less type.

What is claimed is:

1. A cleaning member for use in contact with a photosensitive member in an electrophotographic process to remove paper dust adhered to the photosensitive member, the cleaning member comprising:

a base fabric; and fibers implanted on a surface of the base fabric and lying substantially flat in directions along the surface of the base fabric when out of pressure contact with another surface, wherein the arrangement density of the fibers is in a range of 1,500 to 15,000 pieces/mm$^2$.

2. The cleaning member as claimed in claim 1, wherein the fibers extend in various directions along the surface of the base fabric.

3. The cleaning member as claimed in claim 1, wherein the fibers include a plurality of fiber bundles that are formed by tying a plurality of fibers together and that are arranged as being dispersed on the surface of the base fabric.

4. The cleaning member as claimed in claim 1, wherein the diameter of each fiber is in a range of 5 to 10 μm.

5. The cleaning member as claimed in claim 1, wherein the length of each fiber is in a range of 0.5 to 0.7 mm.

6. The cleaning member as claimed in claim 1, further comprising an elastic member that is fixed to a back face of the base fabric opposite to the surface of the base fabric on which the fibers are implanted and that is configured to be elastically deformed.

7. The cleaning member as claimed in claim 6, wherein the elastic member has an elastic force smaller than or equal to 60 N.

8. The cleaning member as claimed in claim 6, wherein the elastic member includes an elastically deformable plate member, the base fabric being fixed to a free end of the plate member.

9. A cleaning member for use in contact with a photosensitive member in an electrophotographic process to remove paper dust adhered to the photosensitive member, the cleaning member comprising:

a base fabric; and fibers implanted on a surface of the base fabric and lying substantially flat in directions along the surface of the base fabric when out of pressure contact with another surface;

an elastic member that is fixed to a back face of the base fabric opposite to the surface of the base fabric on which the fibers are implanted and that is configured to be elastically deformed, wherein the elastic member has an elastic force smaller than or equal to 60 N.

10. The cleaning member as claimed in claim 9, wherein the fibers extend in various directions along the surface of the base fabric.

11. The cleaning member as claimed in claim 9, wherein the fibers include a plurality of fiber bundles that are formed by tying a plurality of fibers together and that are arranged as being dispersed on the surface of the base fabric.

12. The cleaning member as claimed in claim 9, wherein the diameter of each fiber is in a range of 5 to 10 μm.

13. The cleaning member as claimed in claim 9, wherein the length of each fiber is in a range of 0.5 to 0.7 mm.

14. The cleaning member as claimed in claim 9, wherein the elastic member includes an elastically deformable plate member, the base fabric being fixed to a free end of the plate member.

15. A cleaning member for use in contact with a photosensitive member in an electrophotographic process to remove paper dust adhered to the photosensitive member, the cleaning member comprising:

a base fabric;

fibers implanted on a surface of the base fabric and lying substantially flat in directions along the surface of the base fabric when out of pressure contact with another surface; and an elastic member that is fixed to a back face of the base fabric opposite to the surface of the base fabric on which the fibers are implanted and that is configured to be elastically deformed, wherein the elastic member includes an elastically deformable plate member, the base fabric being fixed to a free end of the plate member.

16. The cleaning member as claimed in claim 15, wherein the fibers extend in various directions along the surface of the base fabric.

17. The cleaning member as claimed in claim 15, wherein the fibers include a plurality of fiber bundles that are formed by tying a plurality of fibers together and that are arranged as being dispersed on the surface of the base fabric.

18. The cleaning member as claimed in claim 15, wherein the diameter of each fiber is in a range of 5 to 10 μm.

19. The cleaning member as claimed in claim 15, wherein the length of each fiber is in a range of 0.5 to 0.7 mm.

* * * * *